US008704618B2

(12) United States Patent
Nusair

(10) Patent No.: US 8,704,618 B2
(45) Date of Patent: Apr. 22, 2014

(54) MICROWAVE FILTER

(75) Inventor: Marwan E. Nusair, Cincinnati, OH (US)

(73) Assignee: Valentine Research, Inc., Cincinnati, OH (US)

( * ) Notice: Subject to any disclaimer, the term of this patent is extended or adjusted under 35 U.S.C. 154(b) by 557 days.

(21) Appl. No.: 12/983,351

(22) Filed: Jan. 3, 2011

(65) Prior Publication Data

US 2012/0169436 A1 Jul. 5, 2012

(51) Int. Cl.
*H01P 1/203* (2006.01)
*H01P 7/08* (2006.01)

(52) U.S. Cl.
CPC ..... *H01P 1/20381* (2013.01); *H01P 1/20354* (2013.01); *H01P 7/082* (2013.01); *H01P 1/20363* (2013.01)
USPC ..... 333/204; 333/219

(58) Field of Classification Search
USPC ..... 333/204, 205, 219, 235
See application file for complete search history.

(56) References Cited

U.S. PATENT DOCUMENTS 4,074,214 A 2/1978 Aichholzer
4,489,292 A 12/1984 Ogawa
5,023,866 A 6/1991 De Muro
5,192,927 A 3/1993 Lin
5,886,595 A 3/1999 Von Stein
5,977,847 A 11/1999 Takahashi
6,023,608 A 2/2000 Yrjola et al.
6,150,898 A * 11/2000 Kushitani et al. ..... 333/110
2007/0103261 A1* 5/2007 Kawai et al. ..... 333/205
2010/0117766 A1 5/2010 Grondahl et al.

OTHER PUBLICATIONS

Hock, Goh Chin et al.; Meandered Microstrip Open Circuited Stub with Bandstop Characteristic; International Journal of Electronics, Circuits and Systems; pp. 163-167; Mar. 3, 2009.
Haiwen Liu et al.; Dual-Bandgap Characteristics of Spurline Filters and its Circuit Modeling; Microwave and Optical Technology Letters; vol. 49, No. 11; pp. 2805-2807; Nov. 2007.
Bhargava, Anurag et al.; Symmetric and asymmetric-coupled lines band-stop filters at Ku/Ka bands; www.rfdesign.com; pp. 74-76; Mar. 2006.
Hai-Wen Liu et al.; Harmonics Suppression of Wilkinson Power Divider Using Spurlines with Adjustable Rejection Bands; Microwave and Optical Technology Letters; vol. 50, No. 3; pp. 601-604; Mar. 2008.

* cited by examiner

*Primary Examiner* — Benny Lee
*Assistant Examiner* — Gerald Stevens
(74) *Attorney, Agent, or Firm* — Stevens & Showalter LLP

(57) ABSTRACT

A microwave filter is provided that includes a transmission line having a signal input port and a signal output port, a stub connected to the transmission line between the input port and the output port, and a spurline embedded in the stub. The microwave filter is configured to substantially attenuate a frequency while substantially passing at least one predetermined odd harmonic of the frequency.

27 Claims, 8 Drawing Sheets

FIG. 11
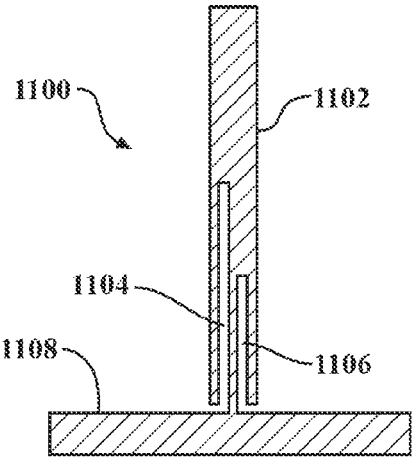
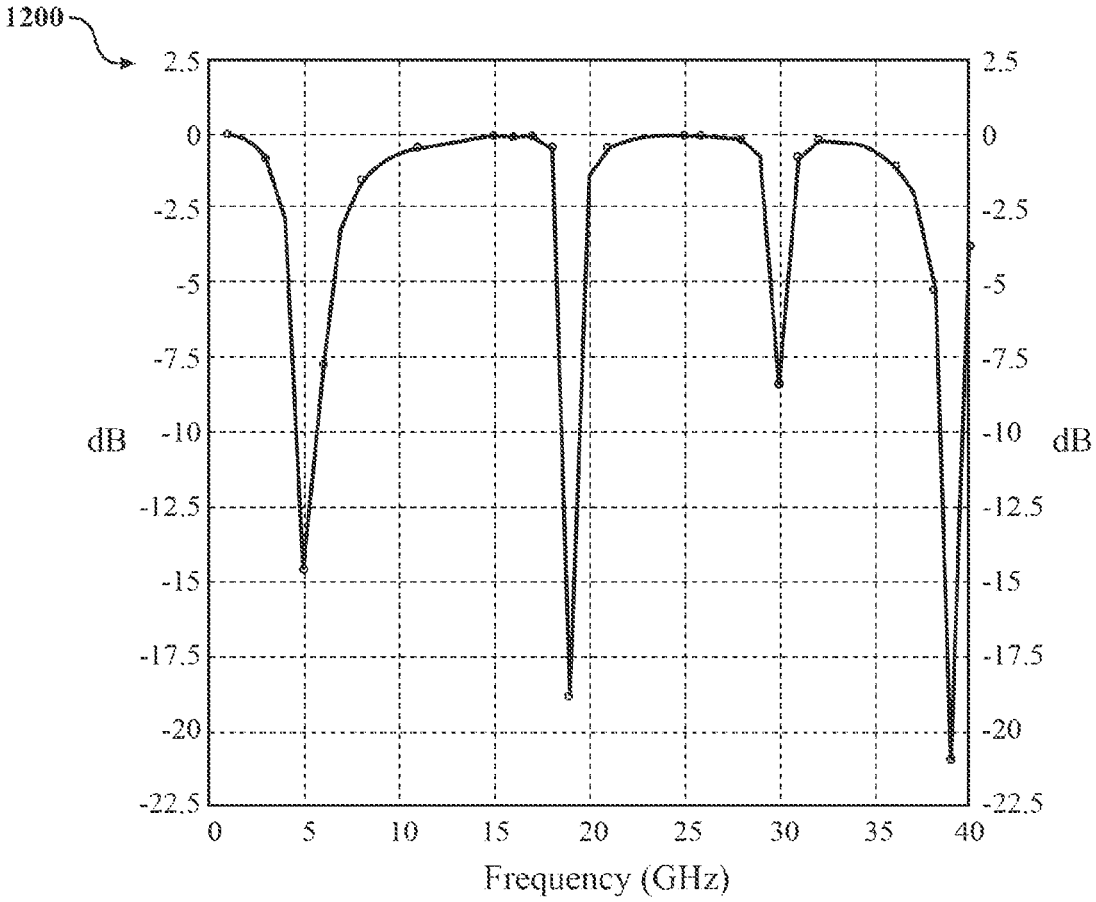
FIG. 12

MICROWAVE FILTER

CROSS REFERENCE TO RELATED APPLICATIONS

The present application is related to U.S. patent application Ser. No. 12/983,361 entitled COMPACT BANDPASS FILTER WITH NO THIRD ORDER RESPONSE which was filed on Jan. 3, 2011, is assigned to the assignee of the present application and is incorporated by reference herein in its entirety. The present application is related to U.S. patent application Ser. No. 12/983,383 entitled METHODS AND APPARATUS FOR RECEIVING RADIO FREQUENCY SIGNALS, now U.S. Pat. No. 8,478,223, which was filed on Jan. 3, 2011, is assigned to the assignee of the present application and is incorporated by reference herein in its entirety.

BACKGROUND OF THE INVENTION

The present invention relates in general to microwave signal processing circuitry and, more particularly, to a microwave filter illustrated in microstrip technology in which it is initially being used.

In microwave circuit design, a so-called "notch filter" can be used to reject a specific frequency range, but allow other frequencies to pass with low loss. The notch filter usually features a sharp notch in its frequency response curve with the notch substantially spanning the rejected frequency range of interest. A known microstrip structure for a notch filter 100 is shown in FIG. 1 wherein microwave energy passes along a microstrip transmission line 102 of the filter 100 from an input end or port 104 to an output end or port 106. An open stub 108, having a nominal electrical length of ¼λ where λ is the wavelength of the desired notch frequency (i.e., the central frequency of the band to be rejected), is connected to the transmission line 102 as shown. One characteristic of an open stub, such as the stub 108 shown in FIG. 1, is that energy at the notch frequency and its odd harmonics is rejected or attenuated as it passes through the transmission line 102. However, energy at frequencies below and in between the odd harmonics of the notch frequency are passed through the transmission line 102, see FIG. 2.

Multiple stubs may be cascaded to enhance the frequency response, for example as shown in FIG. 3, two stubs 108*a*, 108*b* are spaced apart on the transmission line 102. The physical dimensions and relative placement of the stubs 108*a*, 108*b* with respect to the transmission line 102 can be used to adjust the input impedance seen by a source at the input port 104 and thereby may be used to frequency tailor a desired filter response. It can be seen from the frequency response 400 in FIG. 4 that a filter 300 having multiple stubs can be used to extend the depth of the notches (over 55 dB shown in FIG. 4 in comparison to less than 30 dB shown in FIG. 2) and the symmetry of the frequency response. In all cases, however, the odd harmonics or odd multiples of the notch frequency are also suppressed. For example, suppression of the third harmonic appears in both FIGS. 2 and 4.

Another known notch filter circuit 500 shown in FIG. 5 illustrates what is referred to as a "spurline" structure. A spurline 501 is formed by removing an L-shaped portion of a microstrip 502, with one end of the spurline 501 open to one side of the microstrip 502 and the remainder extending along and contained within the microstrip 502. Microwave energy is fed into the microstrip 502 at an input end or port 504 and exits at an output end or port 506. Again, the spurline 501 has a nominal length of ¼ of the wavelength of the desired notch frequency, i.e., a nominal length of ¼λ. As shown in FIG. 6, the filter circuit 500 effectively rejects a desired notch frequency and its associated odd harmonics (only the third harmonic shown). Due to edge effects and other considerations, the frequencies of the rejected harmonics may not be exactly 3, 5, 7 or other odd multiples of the fundamental notch frequency as is known in the art and reflected in FIGS. 2, 4 and 6.

In some applications, it may be desired to reject a specific notch frequency but not the associated third harmonic. In other applications, it may be desired to reject a specific frequency but not at least one specific higher order odd harmonic, such as the 5th, 7th, 9th or other higher order odd harmonic.

In order to reject a specific notch frequency but accept the third harmonic, or some other higher order odd harmonic, normally a more complex circuit is required, such as a combination of cascaded high-pass and low-pass circuits. A more complex circuit in turn demands more space on the circuit board, and entails more loss due to the ohmic losses in the conductor making up the circuit.

SUMMARY OF THE INVENTION

In accordance with the teachings of the present application, a notch filter blocks a central notch frequency but passes at least one select odd harmonic of the central frequency without requiring the complex circuit structures of the prior art. A circuit is coupled to a transmission line and configured to appear to the transmission line as a short circuit at the central frequency and to appear as an open circuit at the at least one select odd harmonic of the central frequency. The currently preferred circuit structure is a stub line that has a spurline embedded therein so that a simple structure is still provided for the notch filter.

According to one aspect of the present invention, a microwave filter comprises a transmission line comprising a signal input port and a signal output port. A stub is connected to the transmission line between the input port and the output port and a spurline is embedded in the stub. The microwave filter is configured to substantially attenuate a frequency while substantially passing a predetermined odd harmonic of the frequency. The stub may have a first electrical length and the spurline a second electrical length with the first and second electrical lengths being fractions of a wavelength of the frequency. The predetermined odd harmonic may comprise the third harmonic of the frequency.

According to another aspect of the present invention, a microwave filter device comprises a transmission line comprising a signal input port and a signal output port. A plurality of stubs are connected to the transmission line between the input port and the output port with each of the plurality of stubs having a spurline embedded therein. The microwave filter device is configured to substantially attenuate a predetermined frequency and substantially pass a predetermined odd harmonic of the frequency. Each of the plurality of stubs has a first electrical length and each of the embedded spurlines has a second electrical length, the first and second electrical lengths being fractions of a wavelength of the predetermined frequency. The plurality of stubs may be arranged to change the frequency response of the microwave filter device.

According to yet another aspect of the present invention, a microwave filter comprises a transmission line comprising a signal input port and a signal output port. A spiral conductor having first and second ends has the first end connected to the transmission line. The spiral conductor has a spurline embedded therein and the microwave filter is configured to substantially attenuate a frequency and substantially pass a predetermined odd harmonic of the frequency. The predetermined odd harmonic may comprise the third harmonic of the frequency and the second end of the spiral conductor may be connected to electrical ground.

According to still another aspect of the present invention, a microwave filter comprises a transmission line comprising a signal input port and a signal output port. A stub has a first end connected to the transmission line between the input port and the output port and a second end connected to a device which is in turn connected to electrical ground. The device is configured to change an electrical length of the stub and a spurline is embedded in the stub. The microwave filter is configured to substantially attenuate a frequency while substantially passing a predetermined odd harmonic of the frequency. The stub has a first electrical length and the spurline has a second electrical length with the first and second electrical lengths being fractions of a wavelength of the frequency. The predetermined odd harmonic may comprise the third harmonic of the frequency and the device may comprise a capacitor, a switch or an inductor.

According to an additional aspect of the present invention, a microwave filter comprises a transmission line comprising a signal input port and a signal output port. A stub is connected to the transmission line between the input port and the output port and first and second spurlines are embedded in the stub. The microwave filter is configured to substantially attenuate a frequency while passing first and second predetermined odd harmonics of the frequency. The stub has a first electrical length, the first spurline has a second electrical length, and the second spurline has a third electrical length with the first, second and third electrical lengths being fractions of a wavelength of the frequency. The first predetermined odd harmonic may comprise the third harmonic of the frequency and the second predetermined odd harmonic may comprise the fifth harmonic of the frequency.

According to a further aspect of the present invention, a microwave filter comprises a transmission line including a signal input port and a signal output port. A first end of a spiral conductor is connected to the transmission line with the spiral conductor being configured to substantially attenuate a frequency. First and second spurlines are embedded in the spiral conductor so that the microwave filter is configured to substantially attenuate a frequency while passing first and second predetermined odd harmonics of the frequency. The second end of the spiral conductor may be connected to electrical ground. The spiral conductor may have a first electrical length, the first spurline may have a second electrical length, and the second spurline may have a third electrical length, the first, second and third electrical lengths being fractions of a wavelength of the frequency. The first predetermined odd harmonic may comprise the third harmonic of the frequency, and the second predetermined odd harmonic may comprise the fifth harmonic of the frequency.

According to yet still another aspect of the present invention, a microwave filter comprises a transmission line including a signal input port and a signal output port. A stub has a first end connected to the transmission line between the input port and the output port and a second end connected to a device which is in turn connected to electrical ground. The device may be configured to change an electrical length of the stub. First and second spurlines are embedded in the stub so that the microwave filter is configured to substantially attenuate a frequency while passing first and second predetermined odd harmonics of the frequency. The first predetermined odd harmonic may comprise the third harmonic of the frequency, and the second predetermined odd harmonic may comprise the fifth harmonic of the frequency. The device may comprise a capacitor, a switch or an inductor.

BRIEF DESCRIPTION OF THE SEVERAL VIEWS OF THE DRAWINGS

The following detailed description of the preferred embodiments of various embodiments of the present invention can be best understood when read in conjunction with the following drawings, where like structure is indicated with like reference numerals, and in which:

FIG. 11 is an open stub microstrip notch filter in accordance with an embodiment of the present invention wherein the stub includes two spurlines;

FIG. 12 is a frequency response plot of the microstrip notch filter of FIG. 11;

DETAILED DESCRIPTION OF THE INVENTION

In the following detailed description of the illustrated embodiments, reference is made to the accompanying drawings that form a part hereof, and in which is shown by way of illustration, and not by way of limitation, specific embodiments in which the invention may be practiced. It is to be understood that other embodiments may be utilized and that changes may be made without departing from the spirit and scope of various embodiments of the present invention. The microwave filter of the present application is described with reference to microstrip technology for which it is initially being used.

Figure 7:
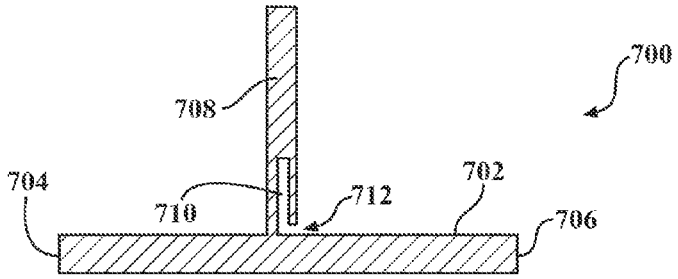
FIG. 7 is an open stub microstrip notch filter in accordance with an embodiment of the present invention wherein the stub includes a spurline.

Reference is made to FIG. 7 which shows an open stub microstrip filter 700 illustrating one embodiment of a notch filter in accordance with the teachings of the present application wherein the filter 700 substantially attenuates a frequency band spanning a central frequency, i.e., the central frequency of the notch filter, while substantially passing a predetermined odd harmonic of the central frequency. As illustrated, the microstrip filter 700 comprises a microstrip transmission line 702 having a signal input end or input port 704 and a signal output end or output port 706. A stub 708 is connected to the transmission line 702 between the input port 704 and the output port 706. An L-shaped spurline 710 is embedded in the stub 708 and has an end 712 opening to the side of the stub 708 adjacent the base of the stub 708 where it is connected to the transmission line 702.

Figure 5:
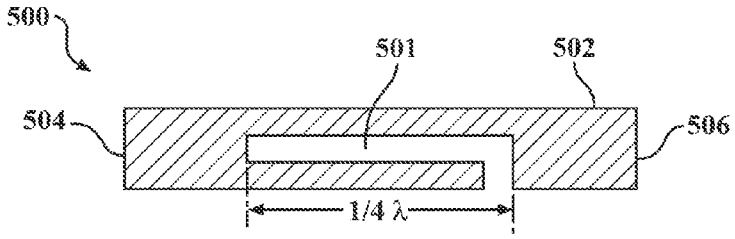
FIG. 5 Prior Art
FIG. 5 is a prior art spurline microstrip notch filter.
Figure 6:
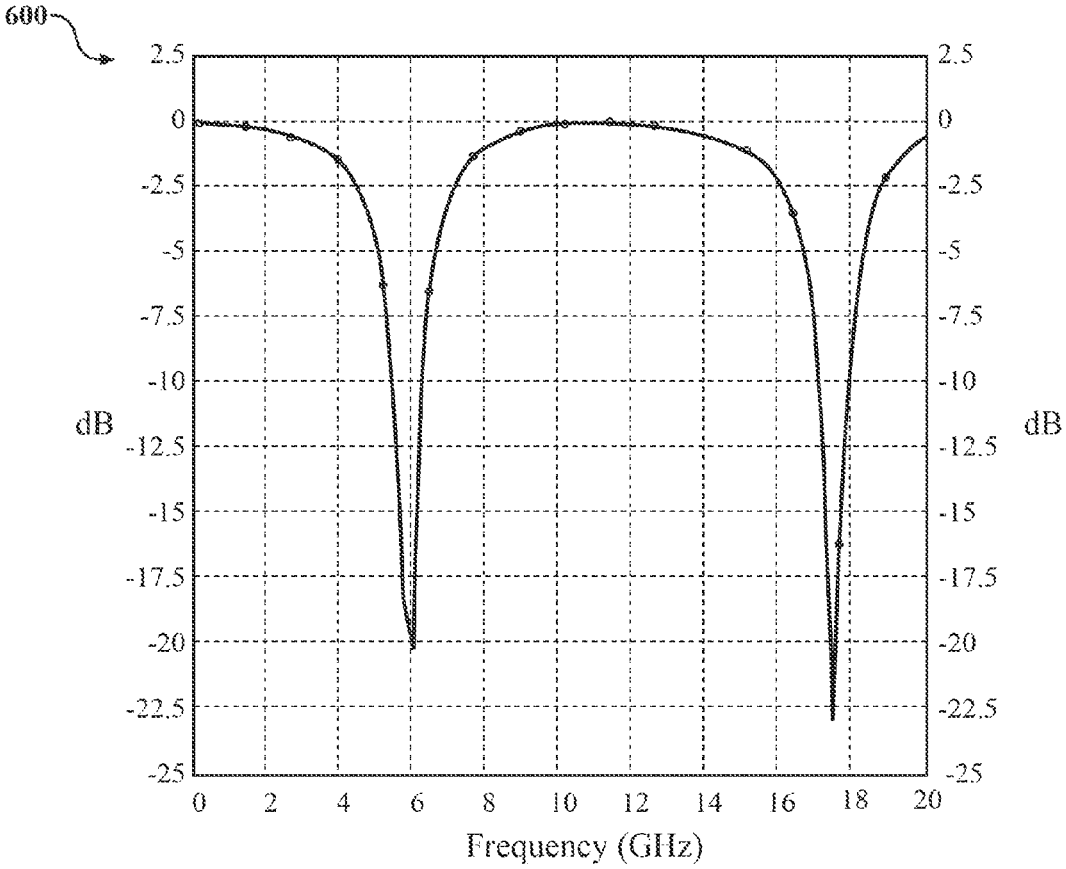
FIG. 6 Prior Art
FIG. 6 is a frequency response plot of the microstrip notch filter of FIG. 5.

How this configuration enables the desired notch filter of the present application becomes apparent when the characteristics of the stub and spurline are considered. The base of an open stub attached to a microstrip through-line presents a short-circuit at a frequency corresponding nominally to a wavelength of 4 times it's length, see FIG. 1. As is known in the art, in reality edge effects and finite-width effects may cause this relationship to vary slightly from it's nominal value. The open stub is also a short circuit at frequencies corresponding to odd fractions of 4 times it's length. For a spurline, the open end, i.e., the short leg or short portion of the L-shaped spurline, becomes an open circuit at frequencies corresponding to odd fractions of 4 times it's nominal length, see FIG. 5 (only third harmonic shown). Thus, at those frequencies, the microwave energy cannot traverse the microstrip through-line since it is effectively an open circuit.

When a spurline is embedded in a stub as illustrated in FIG. 7, the stub becomes invisible at the spurline frequencies since the microwave energy cannot traverse the open circuit presented by the spurline. Thus, the stub can no longer reject that frequency as it did before. The result is that the through-line is short circuited at a desired center frequency f due to the stub to define the notch of the filter, but the customary attenuation produced by the stub is effectively removed at the desired odd harmonic of the notch frequency f by the open circuit of the spurline.

With this understanding, the open stub 708 acts as a short circuit at the center frequency at the base of the stub 712 so that signals at and around the center frequency are shorted out and do not pass through the transmission line 702. And the spurline 710 embedded into the stub 708 acts as an open circuit at certain odd harmonic frequencies determined by the spurline 710. At those odd harmonic frequencies, the stub 708 appears as an open circuit so that microwave energy at those odd harmonic frequencies is not shorted but passes through the transmission line 702. By incorporating the spurline 710 into the open stub 708, the stub appears as a short circuit at a desired center frequency f and, with proper sizing of the spurline 710, appears as an open circuit at an odd harmonic of the center frequency denoted by nf, where n may be 3, 5, 7 or any other higher order odd number.

It is noted that while the transmission line 702 is illustrated as a microstrip line, filters in accordance with the teachings of the present application may be implemented in striplines, waveguides, coaxial cables, or any medium suitable for propagating electromagnetic energy. Thus, filtering in accordance with the teachings of the present application is accomplished by providing a circuit, illustrated in FIG. 7 as the open stub 708 with the embedded spurline 710, that is connected to a transmission medium and appears to the transmission medium as a short circuit at a center frequency to be attenuated and as an open circuit at a higher-order odd harmonic frequency that is to be passed by an associated transmission medium.

For attenuating a notch filter center frequency f having a wavelength of λ but passing the third harmonic of the center frequency f, the nominal dimensions are ¼λ for the stub 708 and one third of ¼λ, i.e., 1/12λ, for the spur 710. The exact lengths of the stub 708 and the spurline 710 within the stub 708 are slightly different from the nominal values of ¼λ and one third of ¼λ, i.e., 1/12λ, as the presence of the spurline 710 impacts the effective electrical length of the open stub 708, and the spurline 710 is impacted itself by it's presence within the open stub 708. As will be apparent to those skilled in the art, small adjustments in stub and spurline lengths yield the desired result, for example rejection of the fundamental notch center frequency but passage of the 3rd harmonic of the notch center frequency. By choosing a value for the spurline of one fifth of ¼λ, i.e., 1/20λ, the fifth harmonic would be preserved but the 3rd, 7th and higher order odd harmonics would be rejected along with the fundamental, etc.

Figure 8:
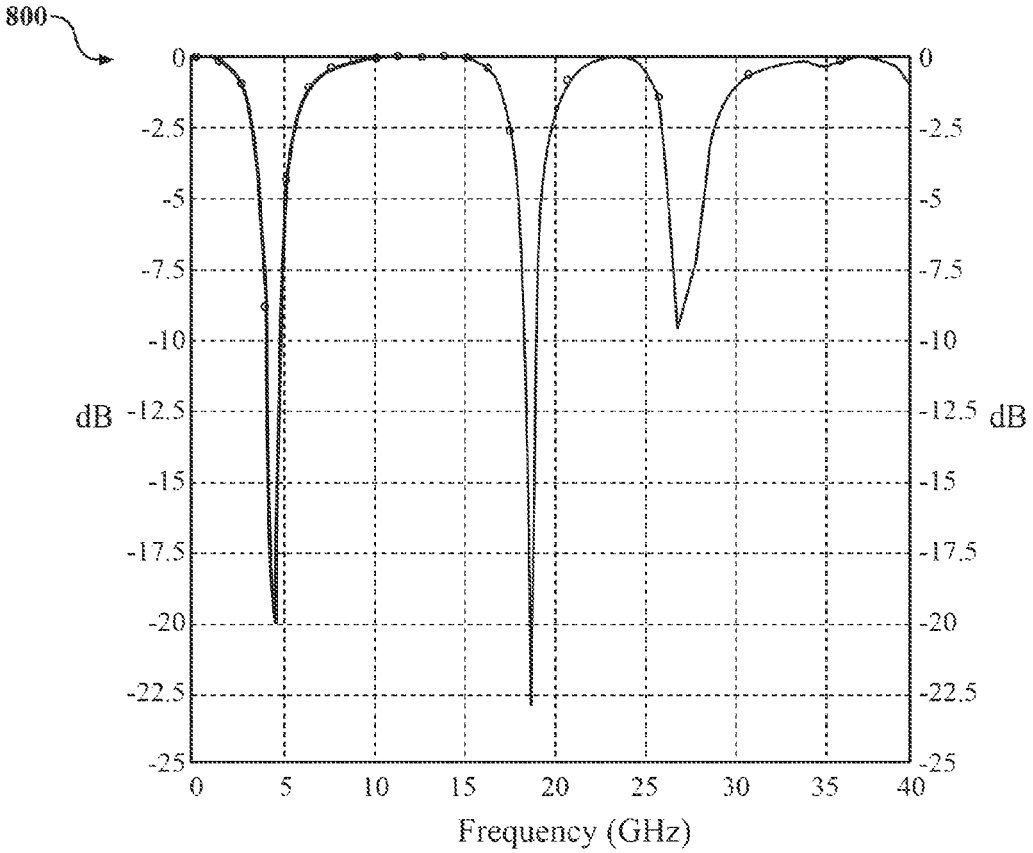
FIG. 8 is a frequency response plot of the microstrip notch filter of FIG. 7.

In the filter characteristics shown in FIG. 8, the fundamental frequency range at around 4 GHz is rejected, as is the 5th harmonic at around 18 GHz, and the 7th harmonic at around 27 GHz. But the 3rd harmonic at around 12 GHz is passed very well, with no discernible loss, which is characteristic of one embodiment of the filters of the present application, for example as illustrated in FIG. 7. In addition, and without necessarily intending to produce this result, the 9th harmonic at around 35 GHz is also passed with minimal loss, because that also happens to be the frequency corresponding to the 3rd harmonic of the spurline 710. Due to the interaction of the open stub and the spurline, it is noted that the odd harmonics do not correspond exactly with the nominal odd harmonics as is apparent from the filter characteristics shown in FIG. 8.

Figure 1:
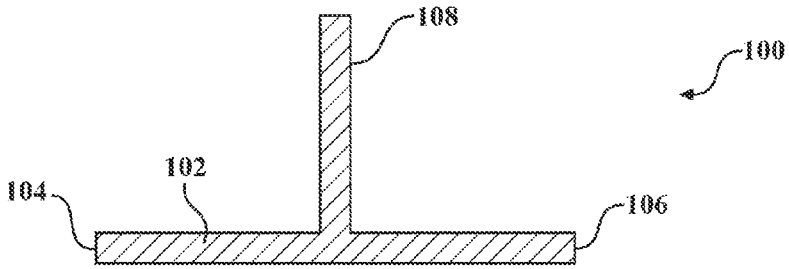
FIG. 1 Prior Art
FIG. 1 is a prior art open stub microstrip notch filter.
Figure 2:
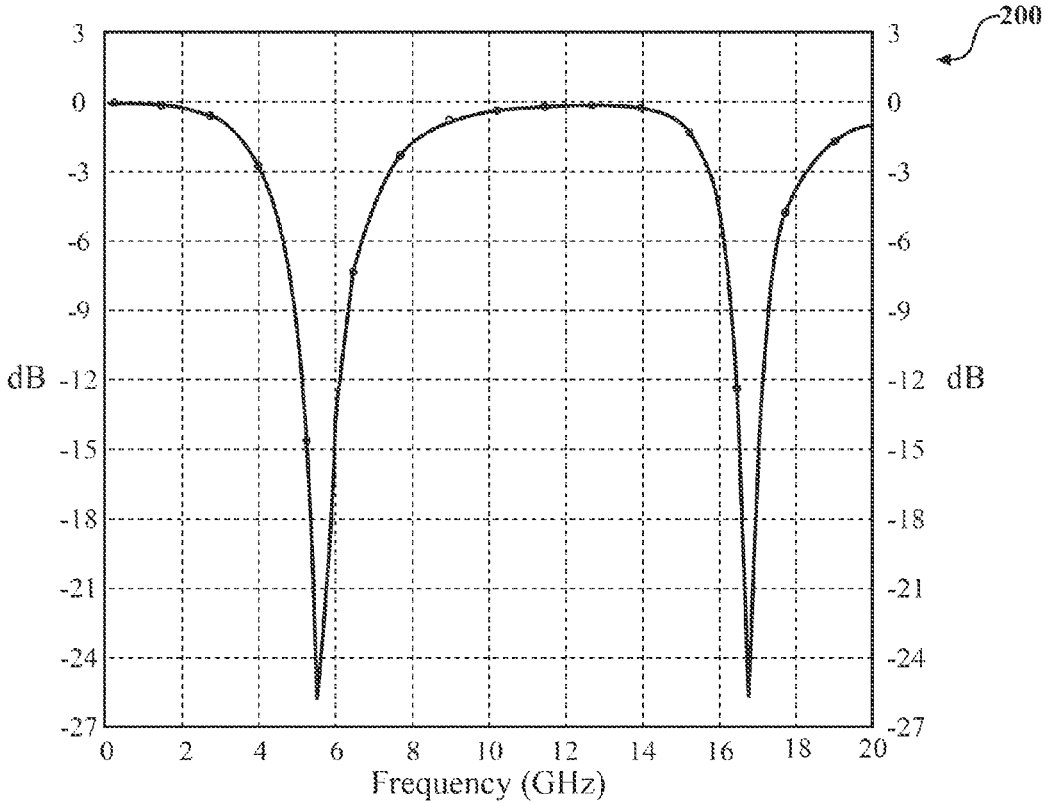
FIG. 2 Prior Art
FIG. 2 is a frequency response plot of the microstrip notch filter of FIG. 1.
Figure 3:
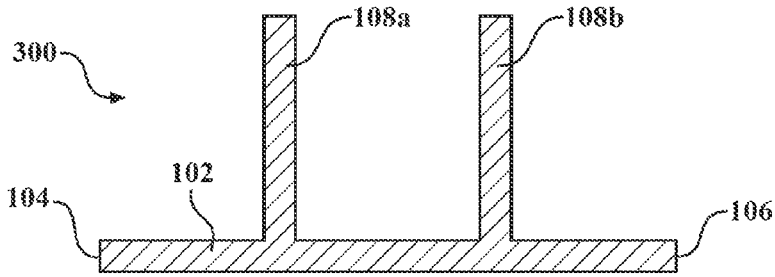
FIG. 3 Prior Art
FIG. 3 is a prior art cascaded open stub microstrip notch filter.
Figure 4:
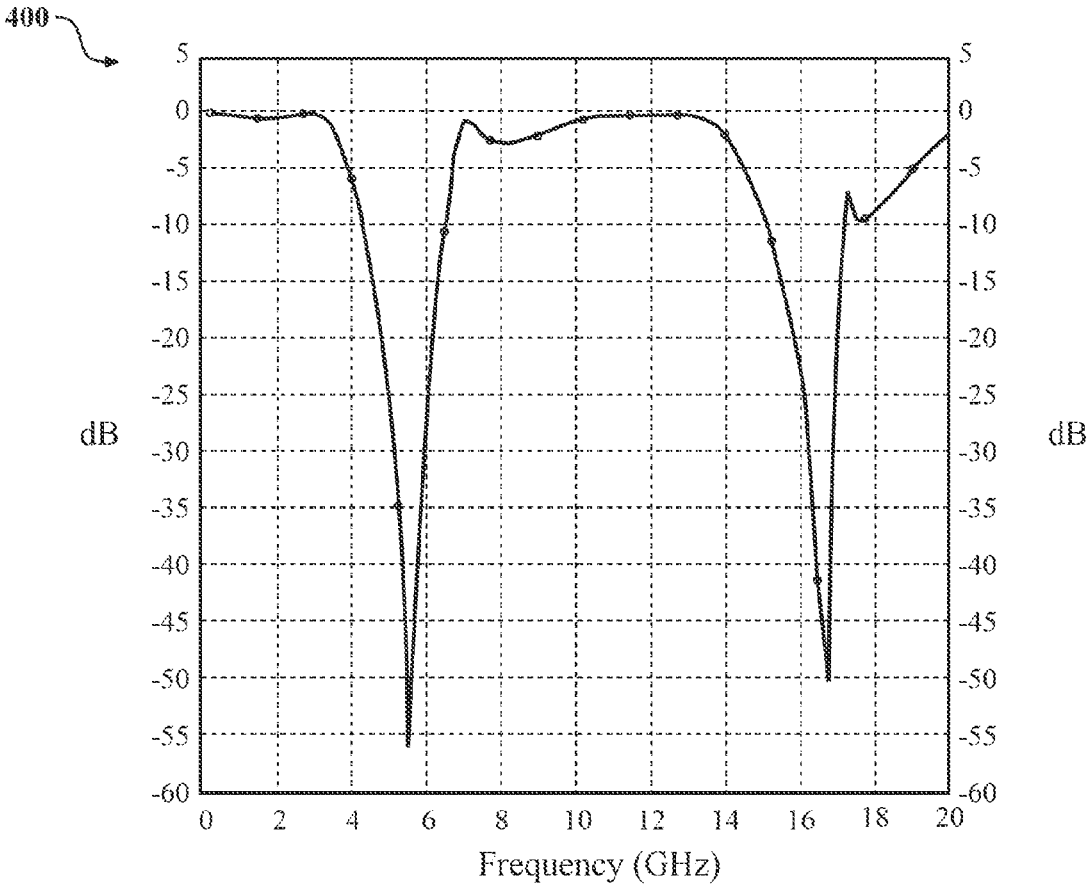
FIG. 4 Prior Art
FIG. 4 is a frequency response plot of the cascaded open stub microstrip notch filter of FIG. 3.

An advantage of the embodiment of FIG. 7 is that the filter is the same size as a simple open stub notch filter as shown in FIG. 1 but achieves the desired result of rejecting a selected notch frequency while also passing a higher order odd harmonic, e.g., the 3rd harmonic as illustrated. The design of the filter allows it to be etched along with the rest of the microstrip circuit, with no other parts required, and no increased use of space beyond that of the basic stub.

Figure 9:
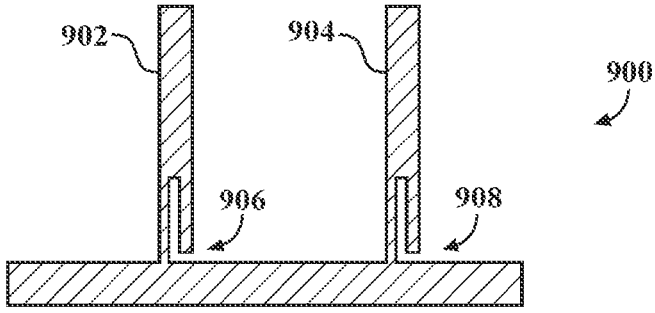
FIG. 9 is a cascaded open stub microstrip notch filter in accordance with an embodiment of the present invention wherein each stub includes a spurline.
Figure 10:
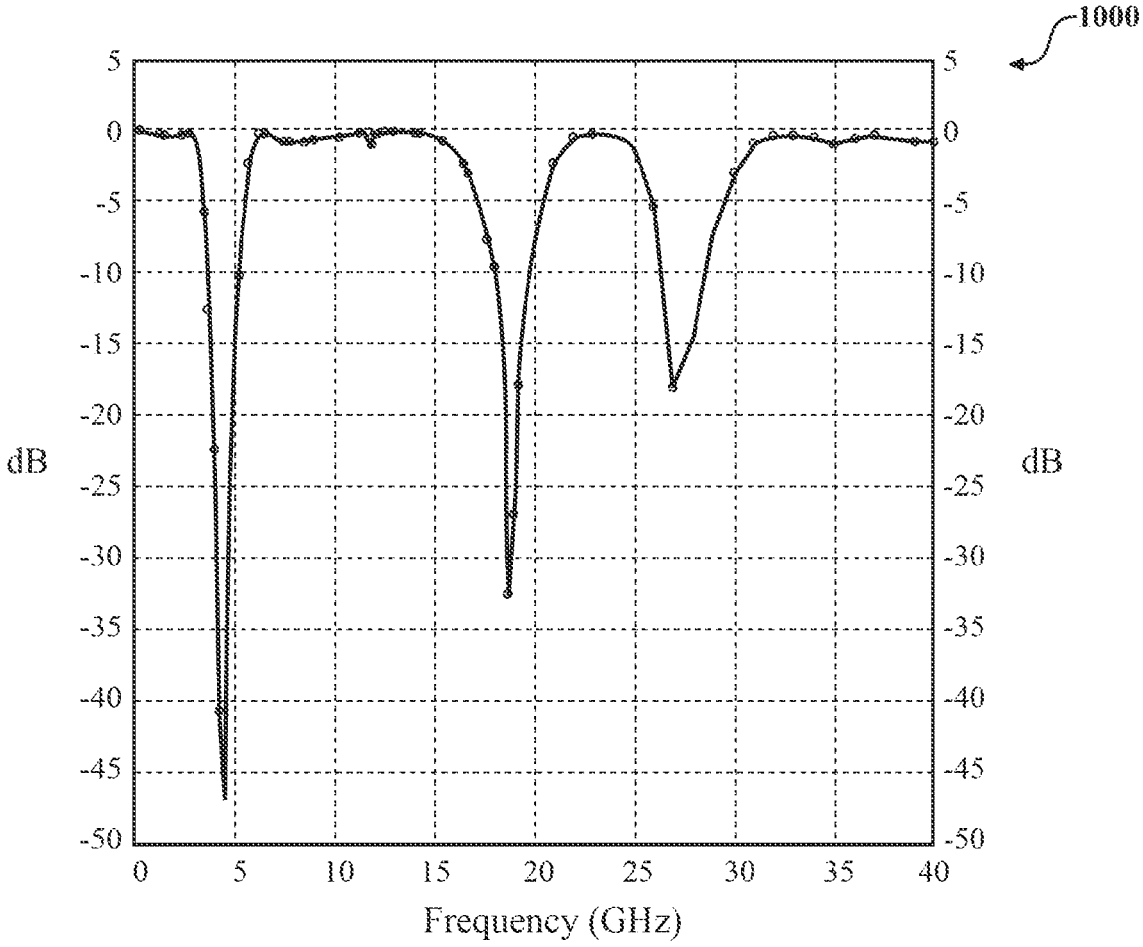
FIG. 10 is a frequency response plot of the cascaded open stub microstrip filter of FIG. 9.

If a deeper notch or asymmetry is required in the frequency response, a cascade microstrip filter 900 can be constructed as shown in FIG. 9. Each of multiple stubs, two stubs 902, 904 being illustrated in FIG. 9, has a spurline 906, 908 incorporated therein, respectively. FIG. 10 shows the frequency response of the multistage filter 900, where both increased notch depth at the fundamental frequency and asymmetry of the frequency response are achieved with no significant attenuation near the 3rd harmonic frequency.

It is also possible in accordance with the teachings of the present application to form two spurlines in a single stub so that a single microstrip filter 1100 is tuned to attenuate a notch filter center frequency f but pass two different odd harmonic frequencies, for example 3f and 5f, the 3rd and 5th harmonics of the center frequency f. As shown in FIG. 11, two spurlines 1104, 1106 are embedded in an open stub 1102 attached to a transmission line 1108. The frequency response 1200 of the filter 1100 is shown in FIG. 12 where the fundamental frequency around 5 GHz is attenuated, while both the 3rd harmonic at around 15 GHz and the 5th harmonic at around 25 GHz are passed with negligible loss. It is noted that a new notch around 20 GHz, between the 3rd and 5th harmonics, is now present. The new notch is a common feature of the design of FIG. 11 dictated by the mathematics of having poles between pairs of zeros and vice versa and must be considered when using the filter design of FIG. 11.

In general, passing one or two higher order odd harmonics of a selected notch filter center frequency f can be realized by selecting the appropriate electrical lengths of each spurline embedded within a stub. As shown in FIG. 11, spurlines with different electrical lengths may be employed to pass any pair of different higher order odd harmonics while suppressing the notch filter center frequency. Two spurlines with approximately identical electrical lengths can be used to increase the bandwidth of the higher order harmonic frequencies that are to be passed.

Figure 13:
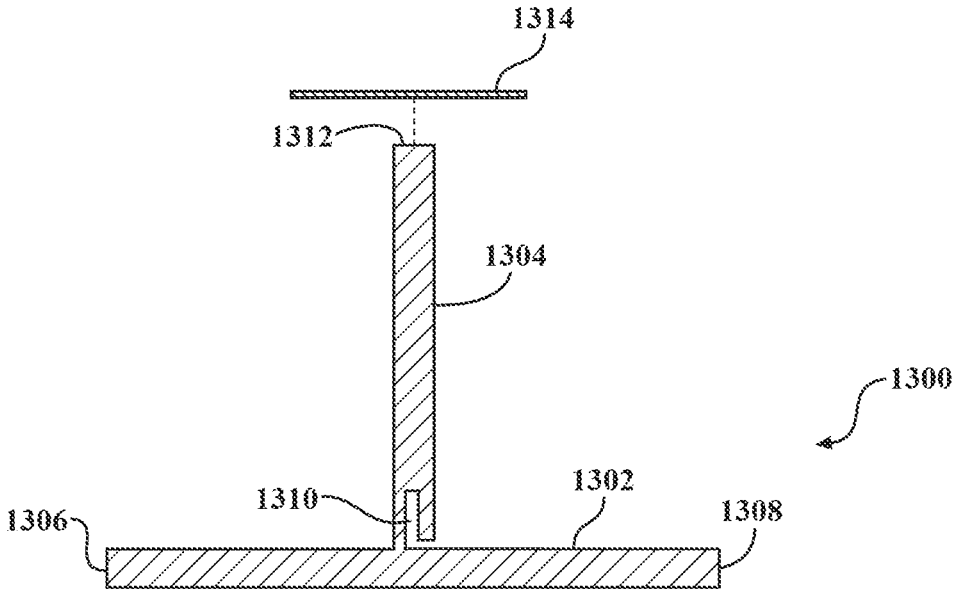
FIG. 13 is a microstrip notch filter in accordance with an embodiment of the present invention wherein the stub includes a spurline and the distal end of the stub can be connected to ground directly, indirectly or through a switch.

While generally not preferred due to the increased length of the stub, as shown in FIG. 13, a shorted stub 1304, i.e., a stub shorted to ground rather than being open circuited, can be connected to a transmission line 1302 between an input port 1306 and an output port 1308. The electrical length of such a shorted stub 1304 may be tuned nominally to half of the wavelength rather than one quarter wavelength as for an open stub. The distal end 1312 of the shorted stub 1304 may be directly or indirectly connected with electrical ground 1314, for example connection can be made using a capacitor, an inductor or a switch (not shown). A spurline 1310 with appropriate electrical length is formed in the shorted stub 1304 to allow certain odd harmonics to pass through with negligible loss.

Figure 14:
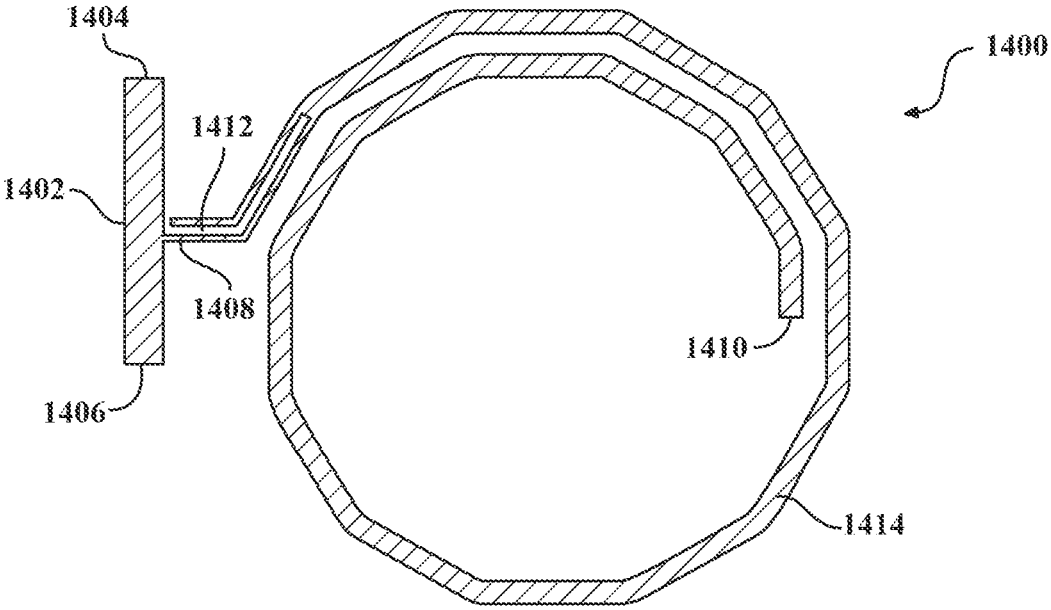
FIG. 14 is an open stub microstrip notch filter using a spiral stub structure wherein the spiral stub includes a spurline.
Figure 14A:
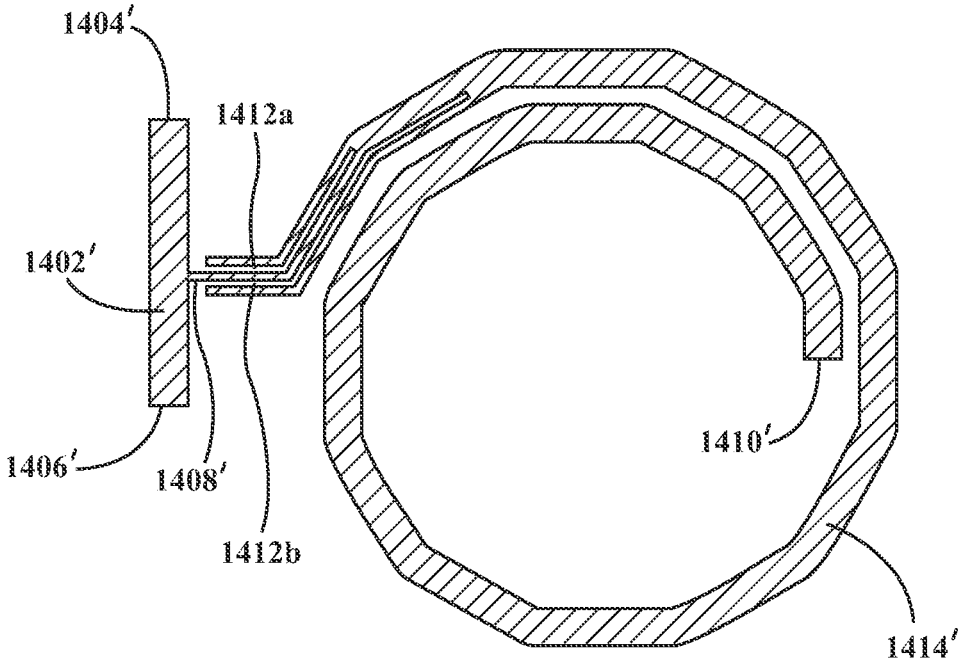
FIG. 14A is an open stub microstrip notch filter using a spiral stub structure wherein the spiral stub includes two spurlines.

In another embodiment of a filter in accordance with the teachings of the present application, a spiral-shaped conductor or stub 1414 is used in a microstrip notch filter 1400 as illustrated in FIG. 14. The spiral stub 1414 may be convenient for specific circuit designs so that the filter fits within limited layout space for the circuit. Microwave energy propagates along a transmission line 1402 from an input port 1404 to an output port 1406. The spiral stub 1414 is connected to the transmission line 1402 at one end 1408 to short-circuit a center frequency f that defines the notch of the filter. The other end 1410 of the spiral stub 1414 may be open or may be directly or indirectly connected to electrical ground. A spurline 1412 is embedded in the spiral stub 1414 so that the filter 1400 suppresses a desired notch center frequency f but passes a particular higher order odd harmonic of the center frequency f. Of course, multiple spiral stubs can be used in a cascade filter design and two spurlines can be embedded in the one or more spiral stubs as shown in FIG. 14A wherein two spurlines 1412*a* and 1412*b* are shown in a spiral stub 1414' of an open stub microstrip notch filter.

Having thus described the invention of the present application in detail and by reference to preferred embodiments thereof, it will be apparent that modifications and variations are possible without departing from the scope of the invention defined in the appended claims.

What is claimed is:

1. A microwave filter, comprising:

a transmission line comprising a signal input port and a signal output port;

a stub connected to said transmission line between said input port and said output port; and a spurline embedded in said stub, said spurline having an open end facing a side of said stub adjacent a base of said stub where said stub is connected to said transmission line;

wherein said microwave filter is configured to substantially attenuate a frequency while substantially passing a predetermined odd harmonic of said frequency.

2. The microwave filter according to claim 1, wherein said stub has a first electrical length and said spurline has a second electrical length, said first and second electrical lengths being fractions of a wavelength of said frequency.

3. The microwave filter according to claim 1, wherein said predetermined odd harmonic comprises the third harmonic of said frequency.

4. A microwave filter device, comprising:

a transmission line comprising a signal input port and a signal output port; and a plurality of stubs connected to said transmission line between said input port and said output port, each of said plurality of stubs having an embedded spurline having an open end facing a side of said stub adjacent a base of said stub where said stub is connected to said transmission line;

wherein said microwave filter device is configured to substantially attenuate a predetermined frequency and substantially pass a predetermined odd harmonic of the frequency.

5. The microwave filter device according to claim 4, wherein each of said plurality of stubs has a first electrical length and each of said embedded spurlines has a second electrical length, said first and second electrical lengths being fractions of a wavelength of said frequency.

6. The microwave filter device according to claim 4, wherein said plurality of stubs are arranged to change a frequency response of said microwave filter device.

7. A microwave filter, comprising:

a transmission line comprising a signal input port and a signal output port;

a spiral conductor having a first end connected to said transmission line and a second end; and a spurline embedded in said spiral conductor, said spurline having an open end facing a side of said spiral conductor adjacent a base of said spiral conductor where said spiral conductor is connected to said transmission line;

wherein said microwave filter is configured to substantially attenuate a frequency and substantially pass a predetermined odd harmonic of said frequency.

8. The microwave filter according to claim 7, wherein said predetermined odd harmonic comprises the third harmonic of said frequency.

9. The microwave filter according to claim 7, wherein said second end of said spiral conductor is connected to electrical ground.

10. A microwave filter, comprising:

a transmission line comprising a signal input port and a signal output port;

a stub having a first end connected to said transmission line between said input port and said output port and a second end connected to a device which is in turn connected to electrical ground, wherein said device is configured to change an electrical length of said stub; and a spurline embedded in said stub, said spurline having an open end facing a side of said stub adjacent a base of said stub where said stub is connected to said transmission line;

wherein said microwave filter is configured to substantially attenuate a frequency while substantially passing a predetermined odd harmonic of said frequency.

11. The microwave filter according to claim 10, wherein said stub has a first electrical length and said spurline has a second electrical length, said first and second electrical lengths being fractions of a wavelength of said frequency.

12. The microwave filter according to claim 10, wherein said predetermined odd harmonic comprises the third harmonic of said frequency.

13. The microwave filter according to claim 10, wherein said device comprises a capacitor.

14. The microwave filter according to claim 10, wherein said device comprises a switch.

15. The microwave filter according to claim 10, wherein said device comprises an inductor.

16. A microwave filter, comprising:

a transmission line comprising a signal input port and a signal output port;

a stub connected to said transmission line between said input port and said output port;

a first spurline embedded in said stub; and a second spurline embedded in said stub, each of said first and second spurlines having an open end facing a side of said stub adjacent a base of said stub where said stub is connected to said transmission line;

wherein said microwave filter is configured to substantially attenuate a frequency while passing first and second predetermined odd harmonics of said frequency.

17. The microwave filter according to claim 16, wherein said stub has a first electrical length, said first spurline has a second electrical length, and said second spurline has a third electrical length, said first, second and third electrical lengths being fractions of a wavelength of said frequency.

18. The microwave filter according to claim 16, wherein said first predetermined odd harmonic comprises the third harmonic of said frequency, and said second predetermined odd harmonic comprises the fifth harmonic of said frequency.

19. A microwave filter, comprising:

a transmission line including a signal input port and a signal output port;

a spiral conductor having a first end connected to said transmission line, said spiral conductor being configured to substantially attenuate a frequency;

a first spurline embedded in said spiral conductor; and a second spurline embedded in said spiral conductor, each of said first and second spurlines having an open end facing a side of said spiral conductor adjacent a base of said spiral conductor where said spiral conductor is connected to said transmission line;

wherein said microwave filter is configured to substantially attenuate a frequency while passing first and second predetermined odd harmonics of said frequency.

20. A microwave filter according to claim 19, wherein a second end of said spiral conductor is connected to electrical ground.

21. The microwave filter according to claim 19, wherein said spiral conductor has a first electrical length, said first spurline has a second electrical length, and said second spurline has a third electrical length, said first, second and third electrical lengths being fractions of a wavelength of said frequency.

22. The microwave filter according to claim 19, wherein said first predetermined odd harmonic comprises the third harmonic of said frequency, and said second predetermined odd harmonic comprises the fifth harmonic of said frequency.

23. A microwave filter, comprising:

a transmission line including a signal input port and a signal output port;

a stub having a first end connected to said transmission line between said input port and said output port and a second end connected to a device which is in turn connected to electrical ground, wherein said device is configured to change an electrical length between said second end and said device and electrical ground;

a first spurline embedded in said stub; and a second spurline embedded in said stub, each of said first and second spurlines having an open end facing a side of said stub adjacent a base of said stub where said stub is connected to said transmission line;

wherein said microwave filter is configured to substantially attenuate a frequency while passing first and second predetermined odd harmonics of said frequency.

24. The microwave filter according to claim 23, wherein said first predetermined odd harmonic comprises the third harmonic of said frequency, and said second predetermined odd harmonic comprises the fifth harmonic of said frequency.

25. The microwave filter according to claim 23, wherein said device comprises a capacitor.

26. The microwave filter according to claim 23, wherein said device comprises a switch.

27. The microwave filter according to claim 23, wherein said device comprises an inductor.

* * * * *